US007069845B2

(12) United States Patent
Righele

(10) Patent No.: US 7,069,845 B2
(45) Date of Patent: Jul. 4, 2006

(54) EQUIPMENT FOR THE AUTOMATIC TRAY POSITIONING OF ARTICLES, IN PARTICULAR SAUSAGES OR OTHER ALIMENTARY PRODUCTS

(75) Inventor: Giovanni Battista Righele, Zane' (IT)

(73) Assignee: REFIN s.r.l., Vicenza (IT)

( * ) Notice: Subject to any disclaimer, the term of this patent is extended or adjusted under 35 U.S.C. 154(b) by 320 days.

(21) Appl. No.: 10/473,145

(22) PCT Filed: Oct. 31, 2002

(86) PCT No.: PCT/EP02/12175

§ 371 (c)(1),
(2), (4) Date: Oct. 8, 2003

(87) PCT Pub. No.: WO03/059746

PCT Pub. Date: Jul. 24, 2003

(65) Prior Publication Data

US 2004/0099155 A1 May 27, 2004

(30) Foreign Application Priority Data

Jan. 18, 2002 (IT) ..... MI2002A0089

(51) Int. Cl.
*A47J 37/00* (2006.01)
*A01J 11/00* (2006.01)

(52) U.S. Cl. ..... 99/486; 99/353; 99/440; 99/441; 99/443 C; 99/468

(58) Field of Classification Search ..... 99/326–331, 99/352–355, 386, 400, 407, 443 R, 443 C, 99/467, 468, 477–479, 486, 487, 516; 452/51, 452/135, 125, 128, 136, 160, 194; 53/444, 53/76, 285
See application file for complete search history.

(56) References Cited

U.S. PATENT DOCUMENTS

| | | | | |
|---|---|---|---|---|
| 4,633,652 | A | 1/1987 | Dagenais et al. | 53/444 |
| 4,945,825 | A * | 8/1990 | Florindez | 99/353 |
| 5,033,367 | A * | 7/1991 | Florindez | 99/353 |
| 5,057,055 | A | 10/1991 | Michaud et al. | 452/51 |
| 5,060,562 | A * | 10/1991 | Florindez | 99/353 |
| 5,476,035 | A * | 12/1995 | Florindez | 99/443 C |
| 5,704,195 | A * | 1/1998 | Benz | 53/444 |
| 6,065,390 | A * | 5/2000 | Florindez | 99/334 |
| 6,083,093 | A * | 7/2000 | Williams | 452/51 |
| 6,234,891 | B1 * | 5/2001 | Maria Klaassen | 452/182 |
| 6,237,473 | B1 * | 5/2001 | Morikawa | 99/450.2 |
| 6,327,966 | B1 * | 12/2001 | Bergmeier | 99/327 |
| 6,374,984 | B1 * | 4/2002 | Nagler | 198/382 |

FOREIGN PATENT DOCUMENTS

| | | |
|---|---|---|
| EP | 0896925 A1 | 2/1999 |
| FR | 2211920 | 7/1974 |
| FR | 2722166 | 1/1996 |

* cited by examiner

*Primary Examiner*—Timothy F. Simone
(74) *Attorney, Agent, or Firm*—Jacobson Holman PLLC

(57) ABSTRACT

Equipment for the automatic tray positioning of single cylindrical or spherical pieces. The equipment includes a first conveyor for the feeding of a sequence of single pieces along a first direction and a second intermittent advancement conveyor for the feeding of single trays along a second direction substantially perpendicular to the first direction. There are also provided a first sensor for the detection of the passage of the single pieces, a second sensor for the detection of the passage of the single trays, and an electronic control device that receives signals from the sensors and controls an advancement step of the second conveyor.

14 Claims, 4 Drawing Sheets

EQUIPMENT FOR THE AUTOMATIC TRAY POSITIONING OF ARTICLES, IN PARTICULAR SAUSAGES OR OTHER ALIMENTARY PRODUCTS

This is a nationalization of PCT/EP02/12175 filed Oct. 31, 2002 and published in English.

FIELD OF THE INVENTION

The present invention concerns an equipment for the automatic tray positioning of single pieces, in particular sausages or other alimentary products.

SUMMARY OF THE INVENTION

The equipment according to the invention comprises a first conveyor for the feeding of a sequence of single pieces along a first direction, a second intermittent advancement conveyor for the feeding of single trays along a second direction substantially perpendicular to said first direction, a first sensor for the detection of the passage of single pieces, a second sensor for the detection of the passage of the single trays, and an electronic control device which receives commands from said sensors and controls an advancement step of said second conveyor, with pre-established delay and in measure at least equal to the width of said pieces, at each pre-established number of passages of pieces in correspondence of said first sensor and a further advancement step of said second conveyor, up to a position established by said second sensor and suitable to allow the next empty tray to receive a first piece from said first conveyor, at each predetermined multiple of said pre-established number of passages of pieces in correspondence of said first sensor. The equipment is characterised in that the second conveyor has a substantially horizontal path and the first conveyor has an output chute with an output end substantially parallel to the bottom of the trays.

An oscillating blade is preferably positioned at the output of said first conveyor for the alignment of the pieces at the moment of their entrance into the tray.

BRIEF DESCRIPTION OF THE DRAWINGS

An embodiment of the equipment according to the present invention is illustrated as a non limiting example in the enclosed drawings, in which.

DETAILED DESCRIPTION OF THE PREFERRED EMBODIMENTS

Figure 1:
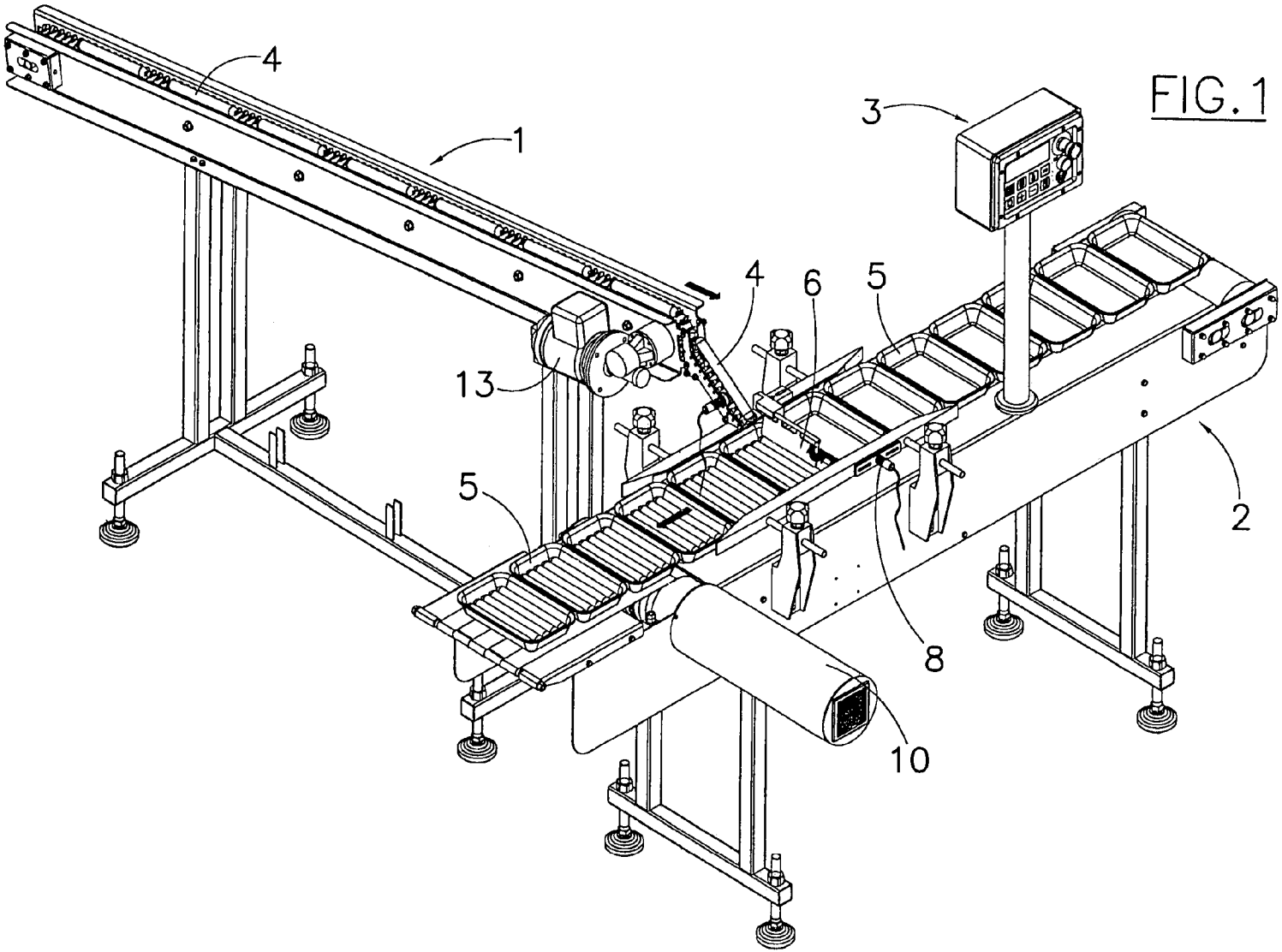
FIG. 1 shows in an overall perspective view equipment according to the invention, provided for the positioning of cylindrical pieces.
Figure 2:
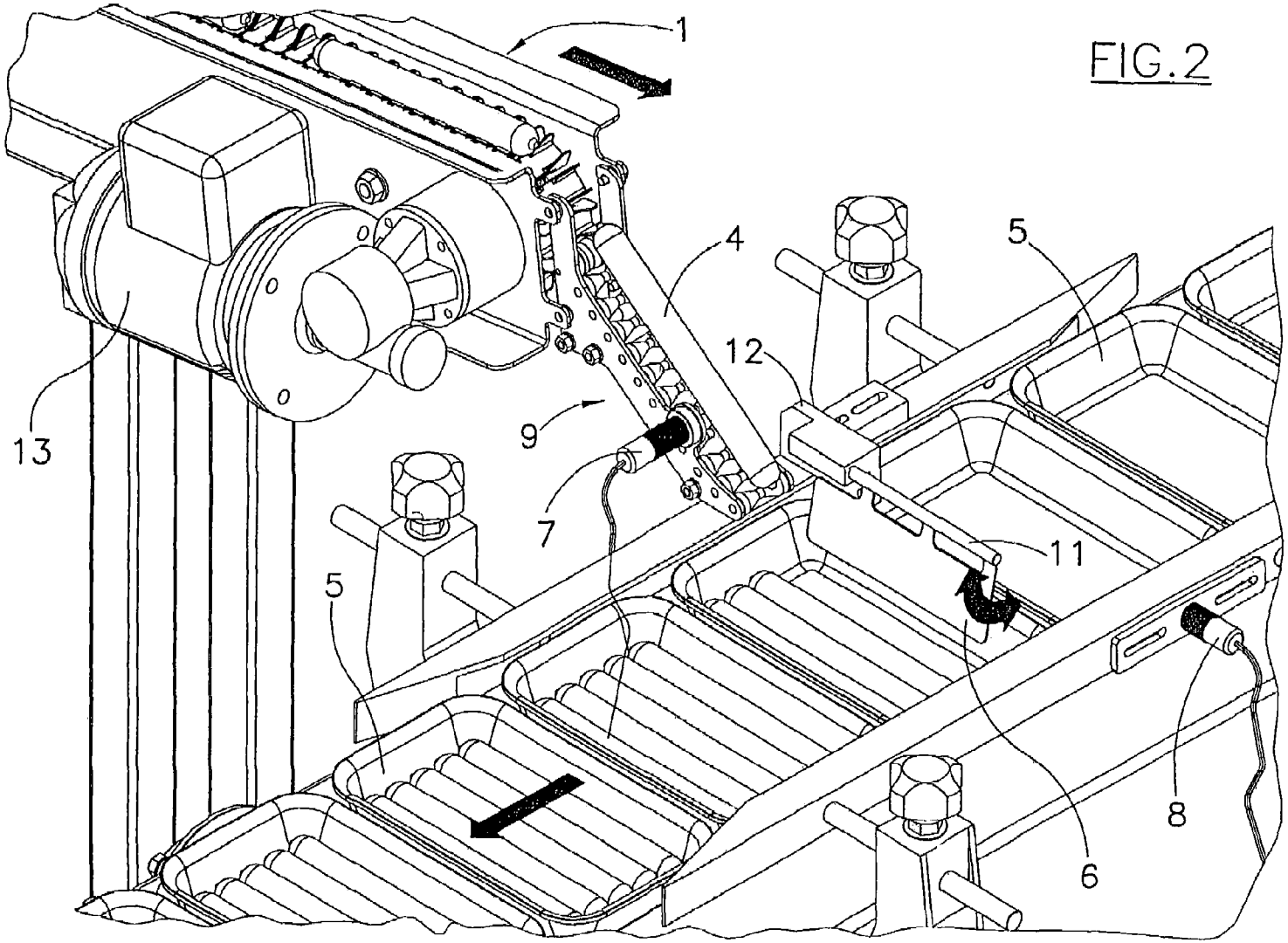
FIG. 2 shows a magnified detail of said equipment, still in perspective view.
Figure 3:
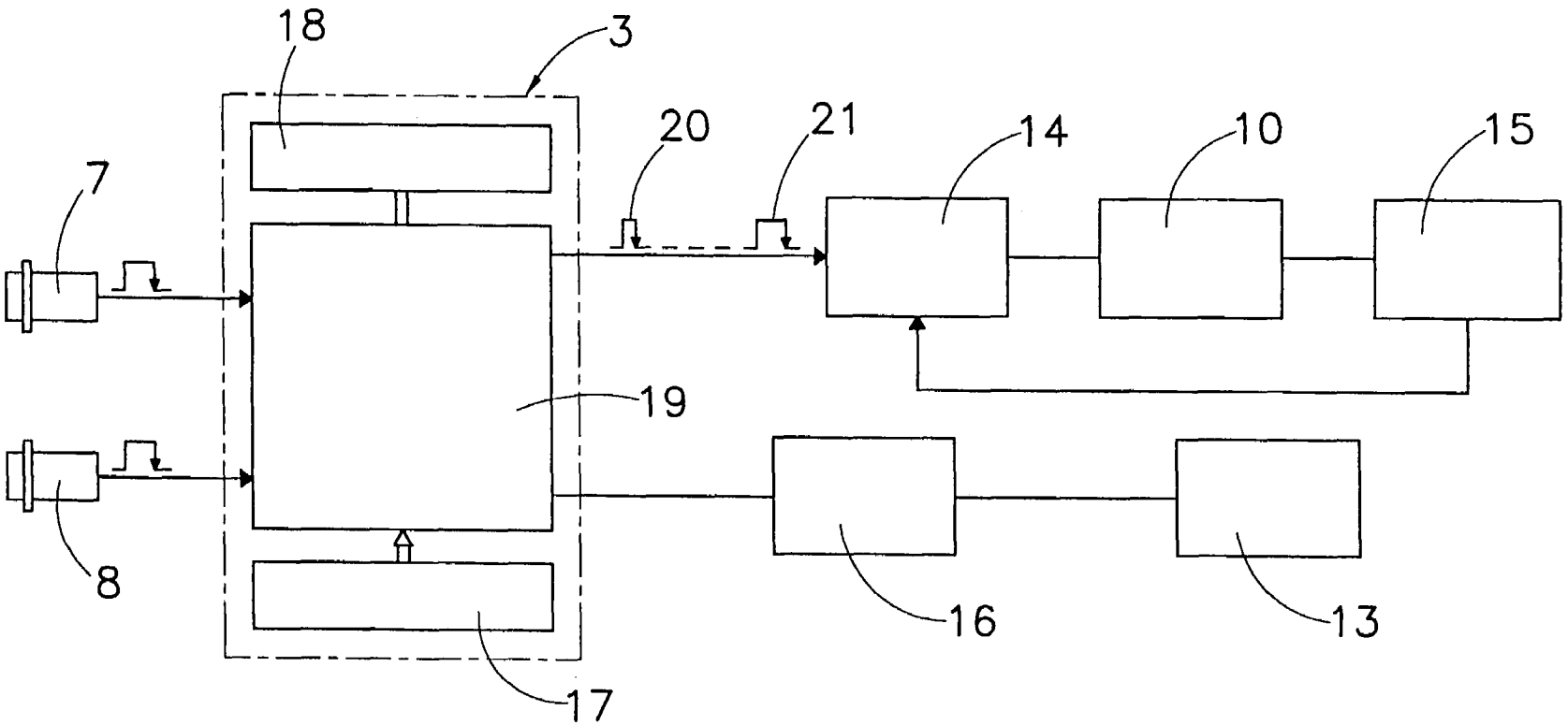
FIG. 3 shows the scheme of the principle of the control system comprised in the aforesaid equipment.

The equipment illustrated in FIGS. 1–3 is specifically addressed to the insertion of a plurality of cylindrical sausages 4 inside trays 5.

The equipment comprises a first conveyor 1 for the conveying of single loose sausages 4 along a first feeding direction and up to an output chute 9 and a second conveyor

2 for the conveying of the trays 5 along a second feeding direction substantially perpendicular to the first one.

The conveyor 1 is set in motion by an electric motor 13 provided with an inverter 16 (FIG. 3) and the conveyor 2 is set in motion by a step-by-step electric motor 10, in particular by a direct current motor provided with starter 14 and tachometric dynamo 15 (FIG. 3).

To the chute 9 a first optical sensor 7 is associated that detects the passage of sausages 4 and to the conveyor 2 a second optical sensor 8 is associated that detects the passage of the trays 5.

An oscillating blade 6 is located at the output of the chute 9 in order to allow the alignment of the single sausages that fall into the tray. The blade 6 is rotatably mounted on a hinge 11 that is fastened onto a fixed support 12 and positioned transversally to the feeding direction of the conveyor 2.

Finally an electronic control device 3 is provided, whose scheme of principle is illustrated in FIG. 3 and comprises a group of buttons 17, a visual display unit 18 and a microprocessor 19 that receives signals from the sensors 7 and 8 and controls the motors 10 and 13 as a function of these.

More precisely, once the equipment has been started through an appropriate button 17, the microprocessor controls the running of the motor 13 for the continuous feeding of loose sausages 4, in sequence one after the other, along the conveyor 1. Through the chute 9 the sausages 4 fall inside the trays 5 one at the time with the alignment allowed by the oscillating blade 6.

Before falling in the tray each single sausage passes in front of the sensor 7, that sends a corresponding signal to the microprocessor 19, that in turn, with a pre-established time delay, gives the motor 10 a command 20 such as to cause an advancement step of the conveyor 2 in measure at least equal to the diameter or width of the sausages 4, in such a way so as to allow the following sausage to get parallel next to the previous sausage.

After a predetermined number of such cycles, that is of each predetermined multiple of said pre-established number of passages in front of the sensor 7, corresponding to the complete filling of the tray, the microprocessor 19 (opportunely provided with the possibility to count) gives the motor 10 a command 21 such as to cause a further advancement step of the conveyor 2 up to a position established by the sensor 8, corresponding to the positioning of a next empty tray at the output of the chute 9, in a position suitable to receive a first sausage from the conveyor 1. The cycle goes on with the filling of the new tray.

At the same time the blade 6, in order to allow the passage of the next tray, rotates around the hinge 11 due to the effect of the thrust received by the edge of the same tray, thus positioning itself in the working position due to the effect of its own weight.

Figure 4:
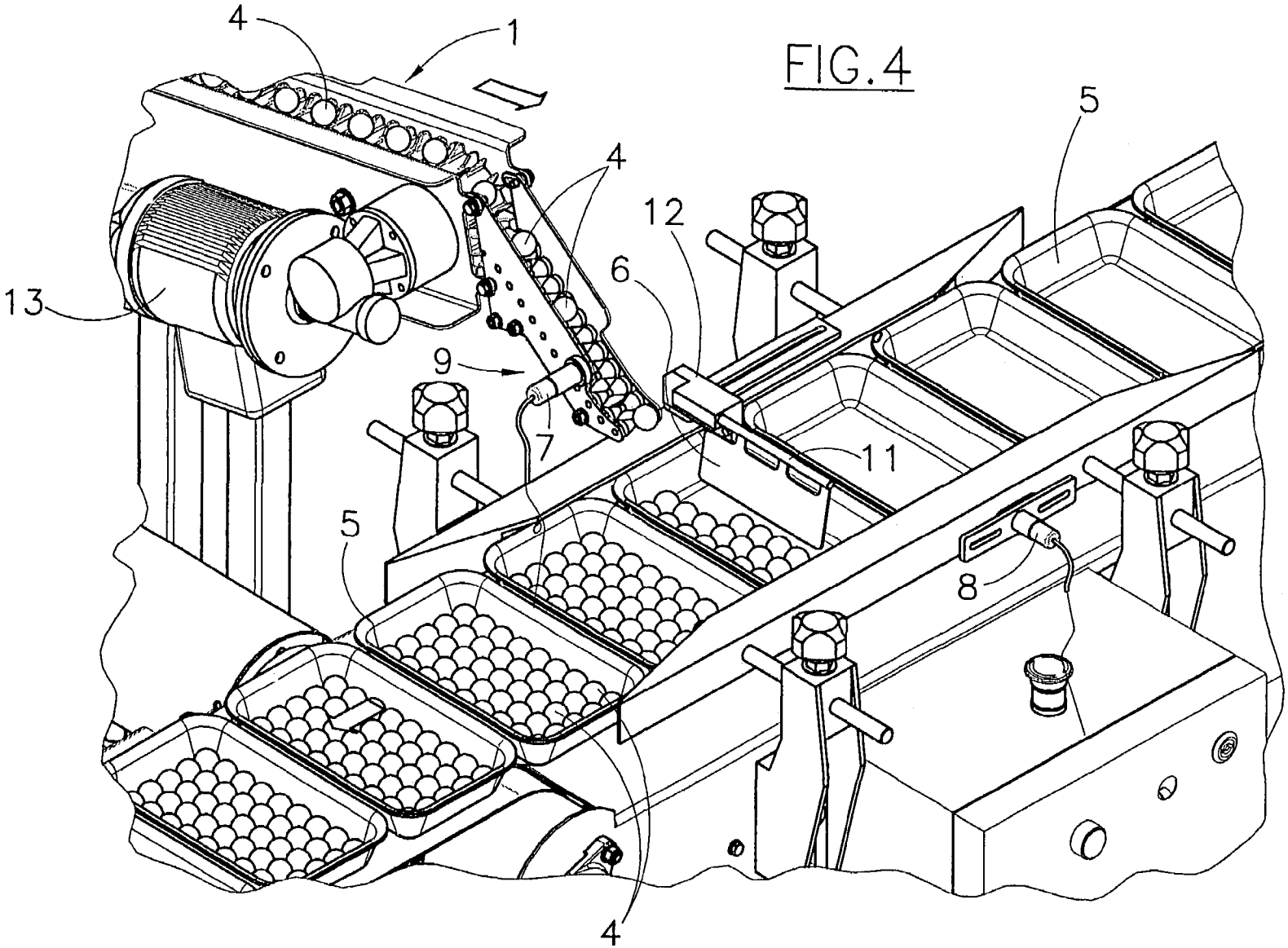
FIG. 4 shows a variation of the equipment according to the invention, provided for the positioning of spherical pieces.

The equipment in FIG. 4 is substantially similar to that one in FIGS. 1–3, with the exception that it is conceived for the filling of the trays 5 with sausages 4 having spherical shape.

To such purpose the microprocessor 19 emits a control 20 only after the sensor 7 has detected a pre-established number of passages of sausages 4.

The invention claimed is:

1. Equipment for automatic tray positioning of single pieces, said equipment comprising a first conveyor for feeding of a sequence of single pieces along a first direction, a second intermittent advancement conveyor for feeding of single trays along a second direction substantially perpendicular to said first direction, a first sensor for detection of passage of the single pieces, a second sensor for detection of the passage of the single trays, and an electronic control device receiving signals from said sensors and controlling an advancement step of said second conveyor with a pre-established delay and a pre-established measure at least equal to a width of said pieces at every pre-established number of passages of the pieces in correspondence with said first sensor and a further advancement step of said second conveyor, up to a position determined by said second sensor, and suitable to allow a next empty tray to receive a first piece from said first conveyor at each predetermined multiple of said pre-established number of passages of pieces in correspondence with said first sensor.

2. Equipment according to claim 1, further comprising a blade supported by a fixed support so as to be able to oscillate around an axis perpendicular to an advancement direction of said second conveyor.

3. Equipment according to claim 1, further comprising a chute located at an output of said first conveyor for dropping of the single pieces inside the trays.

4. Equipment according to claim 1, wherein said pieces have a cylindrical shape.

5. Equipment according to claim 1, wherein said pieces have a spherical shape.

6. Equipment according to claim 4 , wherein said pieces consist of sausages.

7. Equipment for automatic tray positioning of single pieces, said equipment comprising a first conveyor for feeding of a sequence of single pieces along a first direction, a second intermittent advancement conveyor for feeding of single trays along a second direction substantially perpendicular to said first direction, a first sensor for detection of passage of the single pieces, a second sensor for detection of the passage of the single trays, and an electronic control device receiving signals from said sensors and controlling an advancement step of said second conveyor with a pre-established delay and a pre-established measure at least equal to a width of said pieces at every pre-established number of passages of the pieces in correspondence with said first sensor and a further advancement step of said second conveyor, up to a position determined by said second sensor, and suitable to allow a next empty tray to receive a first piece from said first conveyor at each predetermined multiple of said pre-established number of passages of pieces in correspondence with said first sensor, said second conveyor having a substantially horizontal path and said first conveyor having an inclined output chute with an output end extending substantially parallel to a bottom of said trays.

8. Equipment according to claim 7, further comprising a blade located at an output of aid first conveyor for alignment of the single pieces at a moment of entrance of the single pieces into the tray.

9. Equipment according to claim 8, wherein said blade is supported by a fixed support so as to be able to oscillate around an axis perpendicular to an advancement direction of said second conveyor.

10. Equipment according to claim 7, further comprising a chute located at an output of said first conveyor for dropping of the single pieces inside the trays.

11. Equipment according to claim 7, wherein said pieces have a cylindrical shape.

12. Equipment according to claim 7, wherein said pieces have a spherical shape.

13. Equipment according to claim 11, wherein said pieces consist of sausages.

14. Equipment for automatic tray positioning of single pieces, said equipment comprising a first conveyor for feeding of a sequence of single pieces along a first direction, a second intermittent advancement conveyor for feeding of single trays along a second direction substantially perpendicular to said first direction, a first sensor for detection of passage of the single pieces, a second sensor for detection of the passage of the single trays, and an electronic control device receiving signals from said sensors and controlling an advancement step of said second conveyor with a pre-established delay and a pre-established measure at least equal to a width of said pieces at every pre-established number of passages of the pieces in correspondence with said first sensor and a further advancement step of said second conveyor, up to a position determined by said second sensor, and suitable to allow a next empty tray to receive a first piece from said first conveyor at each predetermined multiple of said pre-established number of passages of pieces in correspondence with said first sensor, a blade located at an output of said first conveyor for alignment of the single pieces at a moment of entrance of the single pieces into the tray.

* * * * *